United States Patent [19]

Smith et al.

[11] 4,142,656

[45] Mar. 6, 1979

[54] DROP FORMER UTILIZING GAS PRESSURE

[75] Inventors: Michael R. Smith; James E. Ferris, both of Rochester, N.Y.

[73] Assignee: Eastman Kodak Company, Rochester, N.Y.

[21] Appl. No.: 752,217

[22] Filed: Dec. 17, 1976

[51] Int. Cl.[2] ..... B01L 3/00; B65D 83/14

[52] U.S. Cl. ..... 222/325; 220/367; 222/401; 222/420

[58] Field of Search ..... 222/394, 420, 325, 421, 222/422, 136, 401, 207, 209, 215, 375; 73/61.16, 423 A, 475.4 P, 425.6; 23/253 TP, 253 R, 259; 220/306, 352, 367

[56] References Cited

U.S. PATENT DOCUMENTS

| | | | |
|---|---|---|---|
| 2,758,754 | 8/1956 | Postlewaite | 222/394 X |
| 3,456,694 | 7/1969 | Klein | 222/422 X |
| 3,540,856 | 11/1970 | Rochete et al. | 23/253 X |
| 3,563,415 | 2/1971 | Ogle | 222/420 X |
| 3,650,437 | 3/1972 | Binnings et al. | 222/136 |
| 4,010,000 | 3/1977 | Anderson | 222/420 X |
| 4,030,640 | 6/1977 | Citvin et al. | 222/420 X |
| 4,041,995 | 8/1977 | Columbus | 222/420 X |

*Primary Examiner*—David A. Scherbel
*Attorney, Agent, or Firm*—D. D. Schaper

[57] ABSTRACT

Apparatus is disclosed for drop-by-drop metering of fluids, especially biological fluids. A metering head, connected to a pressure generating means, is adapted to be selectively moved into fluid communication with a sample cup through which the fluid is metered.

11 Claims, 7 Drawing Figures

DROP FORMER UTILIZING GAS PRESSURE

CROSS-REFERENCES TO RELATED APPLICATIONS

Reference is made to commonly-assigned U.S. Patent Applications: Ser. No. 644,014, entitled GAS PRESSURE-ACTIVATED DROP DISPENSER, filed in the name of Richard L. Columbus, on Dec. 24, 1975, now U.S. Pat. No. 4,041,995 and No. 855,124, entitled CHEMICAL ANALYZER, filed in the name of L. Nosco et al. on Nov. 28, 1977.

BACKGROUND OF THE INVENTION (1) Field of the Invention

This invention relates to the chemical analysis of substances, and more particularly, to apparatus for the automatic metering of biological fluids onto test slides.

(2) State of the Prior Art

In recent years, a number of automated systems have been developed for carrying out quantitative chemical analyses of fluid samples. Most of the commercially-available systems utilize liquid reagents and require analyzer equipment having intricate solution handling and transport capabilities. One widely used system, shown in U.S. Pat. No. 2,797,149, employs a continuous-flow technique in which successive samples are separated from one another by immiscible fluid segments such as gas or air bubbles. Such a system is complex and expensive, requires skilled operators, and necessitates a considerable expenditure of time and effort in repetitive cleaning operations.

As an alternative to liquid analysis systems, various essentially-dry analytical elements have been adopted for automated test procedures. Although these elements offer substantial storage and handling conveniences, compared to "wet-chemistry," they have enjoyed only limited success and have been used primarily for qualitative and semi-quantitative test purposes. Apparatus for use with integral analytical elements in the form of continuous webs is shown in U.S. Pat. Nos. 3,036,893, and 3,526,480. Since reagents are contained on the web in a predetermined sequence, the versatility of this apparatus is quite limited. Further, because of the peculiar properties of blood sera and the need to successively dispense samples from different sources, without contamination, such apparatus does not meet the requirements of this invention.

There is disclosed in the aforesaid commonly-owned application of R. Columbus, U.S. Ser. No. 644,014, a recent innovation in devices for metering biological fluids such as blood sera. This application discloses apparatus which dispenses through a cup-like container especially designed to repeatedly dispense precise micro-quantities of blood serum. Each container is used for only one serum sample so that, among other things, contamination problems are alleviated. However, there is no provision in the disclosed apparatus for the metering from substantially closed containers, and the containers must be moved into fluid communication with a stationary metering head.

The patent to G. F. Binnings et al., U.S. Pat. No. 3,574,064, discloses a fluid applicator in which a fluid container comprises a plurality of reservoirs from which a fluid is discharged onto laboratory slides. Each of the reservoirs contains a siphon tube having one end in the fluid and a second end in communication with a discharge orifice. Discharge of the fluid is accomplished by covering the top of the reservoir with a rubber cup which is compressed to produce a slight air pressure over the fluid in the reservoir; the air pressure causes fluid to be forced through the siphon tube and out the discharge orifice. Since the quantity of fluid discharged would vary, depending on the amount of air trapped by the rubber cup and on the degree of compression of the cup walls, this type of applicator would not be suitable for accurately metering extremely small amounts of fluid. The open reservoirs in the fluid container and the open rubber cup would present serious contamination problems.

The patent to Rochete et al., U.S. Pat. No. 3,540,586, discloses a vacuum head which is adapted to be brought into sealing engagement with a filter cup. With the head in the engaged position, a vacuum is applied through the head to lower the pressure within the filter cup, causing filtrate to be drawn into the cup through a porous bottom thereof. There is no suggestion in this patent as to the use of the disclosed apparatus for the precise metering of fluids.

U.S. Pat. No. 2,363,474, discloses a manually operated liquid dispenser having a cover for the metering tip. Such a dispenser, however, is not intended for use with an automatic chemical analyzer.

OBJECTS OF THE INVENTION

It is an object of the invention to provide apparatus for the precise dispensing of micro-sized drops of fluid in which a metering head connected to pressurization means is adapted to be selectively moved into fluid communication with a sample cup through which the fluid is metered.

Another object of the invention is to provide disposable fluid dispensing sample cups, for use in apparatus of the type described, which are substantially free from spillage and contamination.

Other objects and advantages will become apparent from the following Summary and Description of the Preferred Embodiments, when considered in light of the attached drawings.

SUMMARY OF THE INVENTION

The invention relates to a metering or dispensing apparatus for repetitive, precise, dropwise dispensing of microquantities of sample fluids.

In accordance with the invention, there is provided a metering device for use with a chemical analyzer in which fluid is dispensed from a sample cup removably supported adjacent the device in a metering position, the cup being provided on a bottom wall thereof with a dispensing tip suitable for the formation of a pendant drop. The dispensing tip includes an aperture which permits forced fluid flow from a compartment in the cup, the maximum dimension of the aperture being sufficiently small to prevent flow of the fluid under gravity. The sample cup further comprises a top cap having an opening therein in fluid communication with the compartment.

The metering device comprises: head means adapted to be sealingly engaged with the top cap of the cup, the head means including a passageway having a discharge port for supplying fluid pressure to the cup; means for receiving a plurality of sample cups and for successively supporting each of the cups in the metering position with the top cap spaced from the head means, the receiving and supporting means being adapted to precisely locate a cup in the metering position relative to the head means such that the opening in the top cap and the discharge port in the head means are in axial alignment; means for selectively engaging the head means with the top cap to place the discharge port in fluid communication with the opening in the top cap, the means for selectively engaging the head means with the top cap including means for advancing the head means into engagement with the top cap when the cup is in the metering position and means for retracting the head means to permit a new cup to be moved into the metering position; and means for generating a fluid pressure in the passageway in an amount sufficiently above ambient to form a pendant drop on the dispensing tip.

The pressure generating means includes a piston which is operable in a closed passageway. The piston is actuated by a solenoid, or by a stepping motor if a very precise controlled movement of the piston is desired.

The sample cup is preferably formed with a removable top cap and a removable bottom cap which covers the dispensing tip and is adapted to be removed just prior to the metering of fluid from the sample cup. During the metering operation, pressure is supplied to the cup through an opening in the top cap. The disclosed pressurization means operates such that only a relatively small opening is needed in the top cap. Thus, the possibilities for spillage and for contamination of the fluid and the metering head are substantially reduced.

The invention is particularly suitable for use in performing analyses of blood sera in which the serum is dispensed onto a test slide of the type which is formed as a multilayer element containing the necessary reagents for reaction with components of the serum. However, this invention is not limited to use with just such test slides, nor is it limited to just the analysis of blood sera, as other fluids can be used with apparatus of the type disclosed.

DESCRIPTION OF THE PREFERRED EMBODIMENTS

The invention is intended for use in a chemical analyzer in which drops of a biological fluid, such as blood serum, are dispensed onto suitable substrates. Typical of such substrates are those in the form of a test slide, as shown in commonly-owned U.S. Application Ser. No. 588,755, entitled "Improved Multi-Layer Analytical Element Analysis," filed by B. Bruschi, on July 20, 1975; and commonly-owned Belgian Pat. No. 801,742, granted on Jan. 2, 1974.

Preferably, the serum is dispensed in very accurate, small drops, the drop volumes ranging from 1 to about 30 microliters, and preferably between 8 and about 13 microliters. Not only do such small drop volumes permit substantial reduction in equipment size, they also serve to permit multiple tests from a relatively small amount of blood serum. In the case of elderly or of infant patients, only small amounts of blood are available for testing; and, the smaller the individual test drop, the greater the number of tests which can be run on a given small amount of blood. Furthermore, it will be readily appreciated that, regardless of drop shape, each drop should, ideally, be of substantially uniform volume; otherwise, the testing equipment may require recalibration to reflect increased or decreased volume. Preferably, the volume should not change more than about 5% from a preselected value. Additionally, it is desirable that the diameter of the drop be controlled, due to the limited area of the substrate which is designed to receive it.

Figure 1:
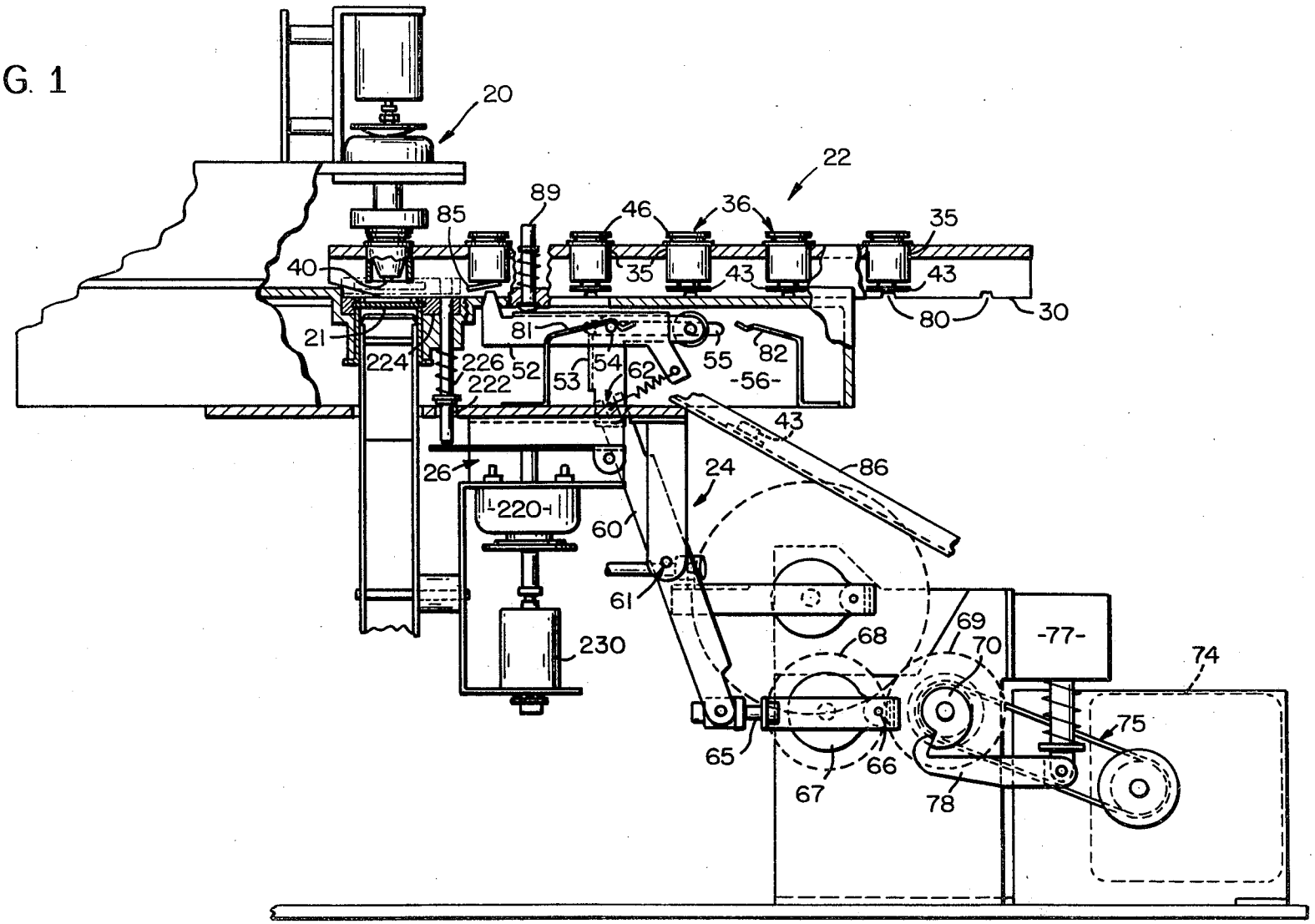
FIG. 1 is a fragmentary elevational view, partially in section, of the metering device of the subject invention, and showing the sample tray and sample tray advance mechanism.

In accordance with a preferred embodiment of the invention, there is shown in FIG. 1 a metering device 20 which is adapted to dispense fluids, such as blood sera, onto a substrate in the form of a test slide 21 in a manner to be described hereinafter. Metering device 20 is particularly suitable for use with the analyzer disclosed in U.S. Application Ser. No. 855,124, entitled "Chemical Analyzer," filed in the name of L. Nosco et al., on Nov. 28, 1977. As described in the Nosco et al. application, fluid samples carried in a sample supply 22 are successively delivered to metering device 20 by an advance mechanism 24. An elevator mechanism 26 is adapted to raise slides into contact with fluid drops formed by metering device 20.

Figure 6:
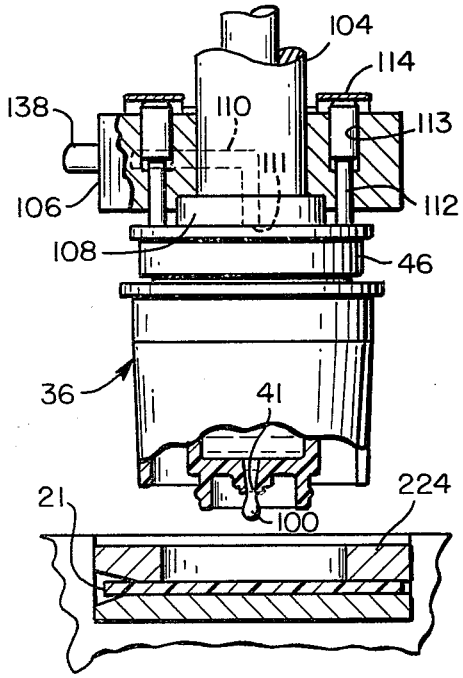
FIG. 6 is an enlarged sectional view, taken along the line 6—6 in FIG. 2, illustrating the metering head and sample cup.
Figure 7:
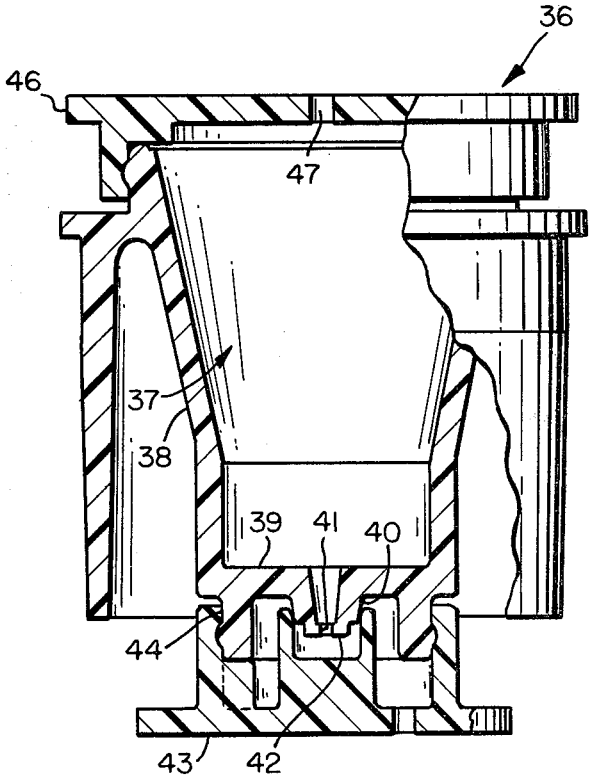
FIG. 7 is an enlarged elevational view, shown partially in section, of the sample cup.

Sample supply 22 comprises a tray 30 and a plurality of sample cups 36 which are removable mounted in holes 35 in the tray 30. Cup 36, as shown in FIGS. 6 and 7, comprises a fluid receiving compartment 37 defined by side wall 38 and a bottom wall 39. A dispensing tip 40, formed on bottom wall 39, includes an aperture 41 through which fluid is metered, the maximum dimension of the aperture being sufficiently small to prevent flow of the fluid under gravity. In the metering of fluid from cup 36, a pendant drop will be formed on a platform 42 on tip 40. A cup which incorporates a dispensing tip of the type used with this invention is described and claimed in the aforesaid commonly-assigned U.S. Application Ser. No. 644,014. A bottom cap 43, which covers aperture 41, is removable secured to a cylindrical wall 44 extending from bottom wall 39. Cap 43 is adapted to prevent contamination, and clogging of aperture 41 due to evaporation of fluids containing protein; the cap is automatically removed just prior to the metering of fluid from the aperture.

A top cap 46 is removably secured on wall 38 and serves to substantially close the open upper end of fluid compartment 37, thereby reducing evaporation and protecting the compartment from contamination. Cap 46 can be removed when fluid is being added to the compartment 37. An opening 47 in cap 46 is adapted to be placed in fluid communication with a pressure generating means during the metering operation, as will be explained more fully hereinafter. Opening 47 can be made relatively small to provide more complete protection from contamination; for example, an opening having a diameter slightly smaller than, or equal to, the diameter of platform 42 has been found suitable. Cup 36 can be formed, by known molding techniques, from copolymers such as acrylonitrile-butadiene-styrene (ABS), and polymers such as actetal, polypropylene, polystyrene, high density polyethylene and polyesters.

Advance mechanism 24 is adapted to move a tray 30 containing a plurality of sample cups 36 from right to left, as viewed in FIG. 1, to successively position the cups 36 in a metering position directly under a metering head 106 on metering device 20. Movement is provided by a pawl 52 which is connected to an element 53 by means of a pin 54 which rides in groove 55 in frame member 56. An arm 60 pivotally mounted at 61 and connected to element 53 at 62 serves to reciprocate pawl 52. Reciprocating motion is transmitted to arm 60 by means of a link 65 which is pinned at 66 to an eccentric 67 carried on gear 68. Gear 68 is driven by a gear 69 connected to a one-revolution clutch 70 which receives power from a motor 74 through a belt drive 75. A solenoid 77 is adapted to release a pawl 78 to start operation of clutch 70.

Upon actuation of clutch 70, gear 68 will pass through one revolution. During the first one-half revolution, pawl 52 will be disengaged from a notch 80 in tray 30 and will be moved, from the position shown in FIG. 1, to the right to engage a new notch 80 in tray 30. During the second one-half revolution of gear 68, pawl 52 will be moved back to the position shown in FIG. 1, thereby moving the tray 30 the distance between two notches 80 and advancing the next cup 36 into the metering position. Springs 81 and 82 are provided to cause pawl 52 to pivot out of a tray notch 80 at the initiation of a tray-advance cycle and to move pawl 52 back into notch 80 just prior to the return stroke. Springs 81, 82, accomplish this function by releasably holding pin 54 at the start of each stroke, thereby causing element 53 to pivot which in turn pivots pawl 52, the direction of pivotal movement depending on the direction of movement of arm 60. A spring-loaded detent, not shown, is adapted to hold tray 30 in position when pawl 52 has been moved out of a notch 80. Tray 30 can be removed from the analyzer by depressing spring-loaded pin 89 to disengage pawl 52 from notch 80, permitting the tray to be pulled out of the analyzer.

As a cup 36 is moved toward the metering position, the bottom cap 43 is engaged by a cam element 85 (see FIG. 1) which serves to remove the cap. Caps 43 fall into a chute 86, a portion of which is shown in FIG. 1.

Figure 2:
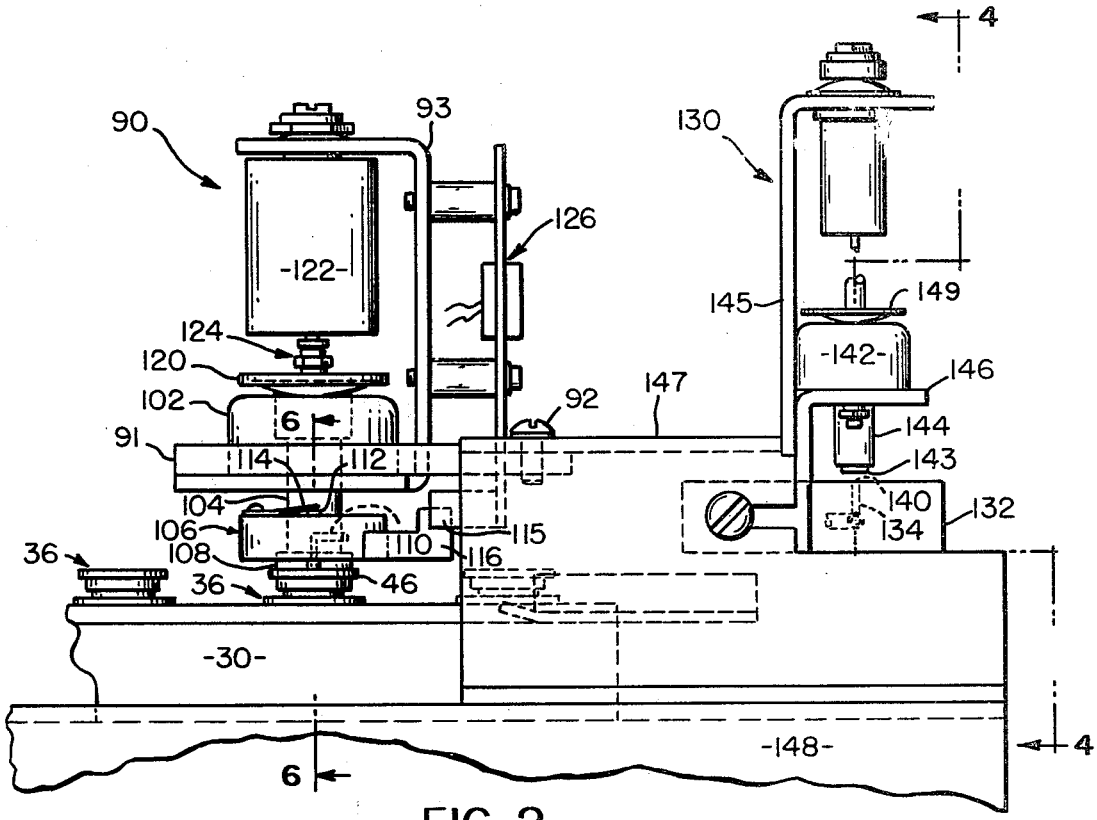
FIG. 2 is an elevational view of the metering device.
Figure 3:
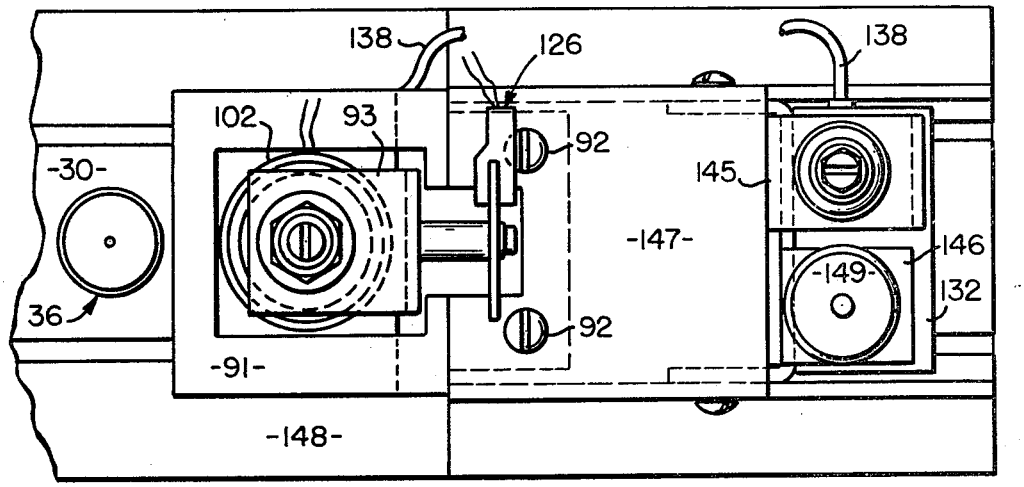
FIG. 3 is a plan view of the device shown in FIG. 2.

A cup 36, in the metering position, is adapted to cooperate with a dispensing mechanism 90 of metering device 20. (See FIGS. 2 and 3.) Dispensing mechanism 90 comprises a plate member 91 fixed by screws 92 to a metering bridge 147 attached to analyzer frame member 148, and a bracket 93 connected to member 91. Mounted on bracket 93 is a push-pull solenoid 102 which includes a plunger 104 connected at its lower end to a metering head 106. A soft silicone pad 108 on the bottom of head 106 is adapted to form a seal against top cap 46. Plunger 104 is movable between a retracted position (solenoid deactuated) to permit a cup to be advanced into the metering position, and an extended position (solenoid actuated) in which pad 108 is in sealing engagement with top cap 46.

Figure 4:
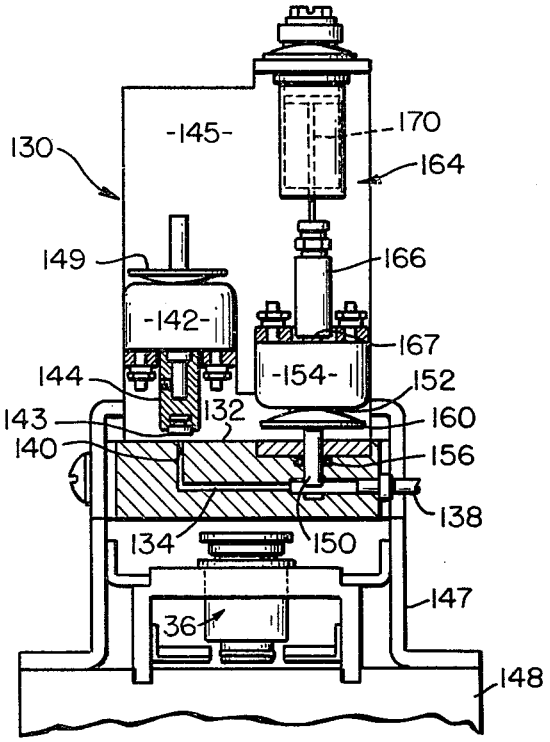
FIG. 4 is a sectional view, taken along the line 4—4 in FIG. 2.

Referring now to FIG. 6, metering head 106 includes a passageway 110 which terminates at one end in a discharge port 111 in pad 108; the other end of passageway 110 is connected to pressure generating means 130 (FIG. 4). A pair of ejector pins 112 are slidably mounted in holes 113 in block 106 and are biased downwardly by leaf springs 114. When plunger 104 is moved to an extended position and pad 108 is moved into contact with cap 46, ejector pins 112 contact cap 46 and are pushed upwardly against springs 114. When plunger 104 is moved to a retracted position, the ejector pins 112 serve to separate pad 108 and top cap 46, thereby preventing cup 36 from being pulled out of tray 30 or cap 46 from being pulled off of cup 36. Plunger 104 is moved to its retracted position by a spring washer 120 (FIG. 2) which serves as a return spring. A dashpot 122 connected to plunger 104 at 124 controls the rate of motion of the plunger.

As will be apparent from the foregoing, a means for selectively engaging metering head 106 with cap 46 is provided through the operation of solenoid 102 in cooperation with spring washer 120. Power is supplied to solenoid 102 through a circuit board 126 (FIG. 2) carried on bracket 93. An optical switch 115, actuated by flag 116 on head 106, senses the vertical position of head 106.

Pressure generating means 130 (FIG. 4) comprises a block 132 carried on bridge 147 and having a passageway 134 therein which is connected to passageway 110 in metering head 106 by means of a tubing 138. Prior to the start of a metering operation, passageway 134 is vented to atmosphere through a vent 140 in block 132; thus, to start the metering operation, a solenoid 142 is actuated to move a silicone pad 143 on plunger 144 into a position in which it closes vent 140. Solenoid 142 is carried on brackets 145, 146, fixed to metering bridge 147. A spring washer 149 is adapted to move plunger 144 to a retracted position at the end of a metering operation.

A piston 150 is movable in passageway 134 to generate sufficient air pressure to form a pendant drop on platform 42 of cup 36. As shown in FIG. 4, piston 150 is formed on an extension of a plunger 152 of a solenoid 154. Piston 150 is mounted for reciprocating movement in block 132, and an O-ring 156 forms an air-tight seal around the piston. At the start of a metering operation, solenoid 154 is actuated to raise piston 150 against the pressure of spring washer 160 which serves to bias the piston downwardly. When it is desired to form a pendant drop, solenoid 154 is deactuated, and spring washer 160 moves piston 150 downwardly. A dashpot 164 connected to solenoid plunger 152 slows the rate of return and allows a stable pendant drop to be formed. The stroke of the piston 150, and thus the volume of the drop, is determined by an adapter 166 which abuts against a top surface 167 of solenoid 154 on the downstroke of plunger 152; adapter 166 is threadably connected to dashpot piston 170 such that the stroke of piston 150 can be adjusted.

Figure 5:
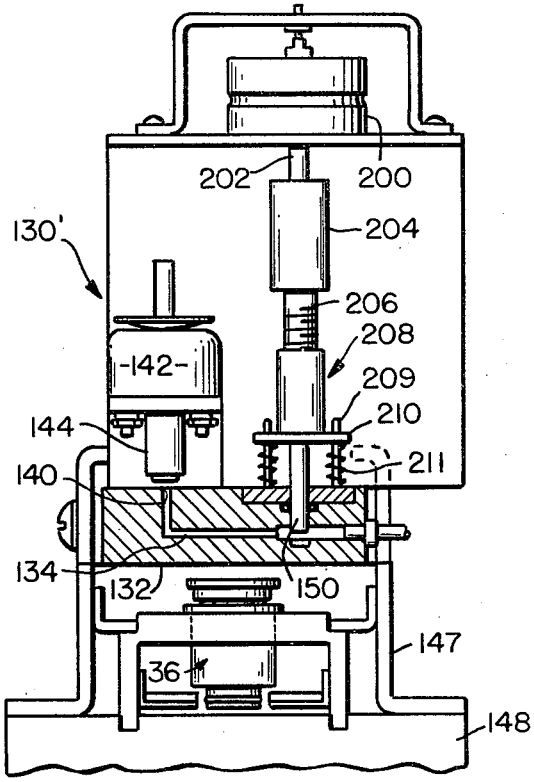
FIG. 5 is a view generally similar to FIG. 4, but showing an alternate construction of the pressure generating means.

Another embodiment of Applicants' invention is shown in FIG. 5 in which a pressure generating means 130' comprises a stepping motor 200 which is employed to actuate piston 150 during the metering operation. Output shaft 202 of motor 200 is connected to a spindle 204 which has an end 206 threadably received in an adapter 208 connected to piston 150. Adapter 208 is prevented from turning by pins 209 which are fixed to block 132 and are slidably received in plate 210 on the adapter. Springs 211 serve to eliminate lost motion in the screw connection between end 206 and adapter 208. Motor 200 is adapted to advance the piston 150 in precise spaced increments, and thus allows the forming of a very stable pendant drop. Motor 200 is reversible to return piston 150 to its starting position. The drop size can be regulated by regulating the number of pulses to the stepping motor, thus providing a simple mechanism for automatically controlling drop volume. Further, the rate of drop formation can be controlled by regulating the frequency of pulses to the motor.

After a pendant drop has been formed on dispensing tip 40, (see, for example, the drop indicated 100 in FIG. 6), slide 21 is elevated by mechanism 26 to effect contact between the drop and the slide, causing the drop to be transferred to the slide. Mechanism 26 comprises a solenoid 220 which serves to raise a pin 222 fixed to a slide holding member 224. When the drop has been transferred to slide 21, solenoid 220 is deenergized, and a return spring 226 moves pin 222 to its starting position. A dashpot 230 is operative to regulate the speed of movement of slide 21.

In the operation of the disclosed metering device, a cup 36 is first moved into the metering position by advance mechanism 24. Metering head 106 is then moved into sealing engagement with the cup top cap 46 by solenoid 102. To form a pendant drop on platform 42 of the dispensing tip 40, elements of the pressure generating means 130 function, as follows:

(1) Solenoid 154 is energized which retracts piston 150 and cocks spring washer 160.

(2) Solenoid 142 is energized to close vent 140, thereby creating a closed system which includes passageway 134, tube 138, passageway 110, and the air volume above fluid in cup 36.

(3) Solenoid 154 is de-energized. The spring washer 160 returns piston 150 to its extended position, thus displacing approximately 10 microliters of air which causes a 10 microliter drop to form on platform 42.

Once a pendant drop has been formed in the above manner, the drop is transferred to a reagent slide by elevating the slide into contact with the drop. As soon as the drop has been transferred, solenoid 142 is de-energized to return the system to ambient pressure. The process can be repeated, if it is desired to dispense fluid from the same cup to more than one slide. It is believed that the functioning of pressure generating means 130' will be clear from the foregoing description. A control system, not shown, for providing power to the various motors and solenoids in timed sequence can be of a conventional type, and thus, no further explanation is considered necessary.

The invention has been defined in detail with reference to a certain preferred embodiment thereof, but it will be understood that variations and modifications can be effected within the spirit and scope of the invention.

What is claimed is:

1. A metering device for use with a chemical analyzer in which fluid is dispensed from a sample cup removably supported adjacent said device in a metering position, said cup being provided on a bottom wall thereof with a dispensing tip suitable for the formation of a pendant drop, said tip having an aperture therein permitting forced fluid flow from a compartment in the cup, the maximum dimension of the aperture being sufficiently small to prevent flow of the fluid under gravity, said cup further comprising a top cap having an opening therein in fluid communication with said compartment, said device comprising:

head means adapted to be sealingly engaged with the top cap, said head means including a passageway having a discharge port for supplying fluid pressure to said cup;

means for receiving a plurality of sample cups and for successively supporting each of said cups in the metering position with the top cap spaced from said head means, said receiving and supporting means being adapted to precisely locate a cup in the metering position relative to said head means such that said opening and said discharge port are in axial alignment;

means for selectively engaging said head means with the top cap to place said discharge port in fluid communication with the opening in said top cap, said means for selectively engaging said head means with the top cap including means for advancing said head means into engagement with the top cap when the cup is in the metering position and means for retracting the head means to permit a new cup to be moved into the metering position; and means for generating a fluid pressure in said passageway in an amount sufficiently above ambient to form a pendant drop on said tip.

2. A metering device, as defined in claim 1, wherein said head means comprises a metering head movable into sealing engagement with a surface on the top cap, and said discharge port is located in said head.

3. A metering device, as defined in claim 2, wherein said metering head comprises a resilient pad and spring-loaded ejector means adapted to separate said pad from the top cap when the metering head is moved away from said surface.

4. A metering device, as defined in claim 1, wherein said means for generating a fluid pressure in said passageway comprises a vent to atmosphere, and a solenoid actuated plunger adapted to close said vent prior to a metering operation.

5. A metering device, as defined in claim 4, wherein said means for generating a fluid pressure comprises a solenoid actuated piston which is adapted to compress air trapped in said passageway, and dashpot means for controlling action of said piston.

6. A metering device, as defined in claim 4, wherein said means for generating a fluid pressure comprises a stepping motor which is coupled to a piston adapted to compress air trapped in said passageway.

7. A metering device, as defined in claim 1, wherein said means for selectively engaging said head means comprises a solenoid coupled to said head means.

8. Apparatus for dispensing fluids onto a substrate, comprising:

holding means for the substrate;

a cup provided with a dispensing tip at the bottom thereof suitable for the formation of a pendant drop, said tip having an aperture permitting forced fluid flow from a fluid compartment in the cup, the maximum dimension of the aperture being sufficiently small to prevent flow of the fluid under gravity;

tray means for receiving a plurality of cups and for supporting the cups above said holding means;

head means adapted to be sealingly engaged over an opening in said cup, said head means including a passageway having a discharge port;

means for selectively moving said head means into position over said cup to place said discharge port in fluid communication with the opening in said cup;

means for generating a fluid pressure in said passageway in an amount sufficiently above ambient to form a pendant drop on said tip;

tray advance means for successively moving each cup into a position to cooperate with said head means; and means for positioning said substrate relative to said dispensing tip to effect transfer of the drop to the substrate.

9. Apparatus, as defined in claim 8, wherein said head means comprises a metering head having a resilient pad thereon, said cup includes a top cap having said opening therein, and said pad being adapted to be moved into sealing engagement with said top cap.

10. Apparatus, as defined in claim 8, wherein said holding means comprises a member capable of supporting a generally flat substrate, and said means for positioning said substrate includes a solenoid coupled to said member.

11. A sample cup for the storage and dispensing of fluids, said cup comprising:

a side wall and a bottom wall which together define a compartment having a fluid capacity sufficient to permit at least one drop to be dispensed therefrom, said bottom wall having a dispensing tip formed thereon, said tip having a platform on an outer surface which includes an aperture therein in fluid cmmunication with said compartment, said platform surrounding said aperture and defining a drop-wettable area which will support a pendant drop, the maximum dimension of said aperture being sufficiently small to prevent flow of the fluid under gravity;

a removable top cap on said cup, said top cap having a hole therein fluid communication with said compartment and in axial alignment with said aperture, the diameter of said hole being generally equal to the diameter of said platform, said top cap having a generally flat surface adapted to sealingly engage a metering head; and a bottom cap which covers said aperture, said bottom cap being removably attached to said cup adjacent said bottom wall.

* * * * *

UNITED STATES PATENT OFFICE

CERTIFICATE OF CORRECTION

PATENT NO. : 4,142,656

DATED : March 6, 1979

INVENTOR(S) : Michael R. Smith; James E. Ferris

It is certified that error appears in the above-identified patent and that said Letters Patent are hereby corrected as shown below:

| | |
|---|---|
| Column 1, Line 10 | before "and" please insert --;-- |
| Column 4, Line 34 | "removable" should read --removably-- |
| Column 4, Line 48 | "removable" should read --removably-- |
| Column 10, Line 4 | "cmmunication" should read --communication-- |
| Column 10, Line 11 | after "therein" insert --in-- |

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*